US007261329B1

(12) United States Patent
Julian et al.

(10) Patent No.: US 7,261,329 B1
(45) **Date of Patent: *Aug. 28, 2007**

(54) SAFETY LATCH ARRANGEMENT

(75) Inventors: Randall K. Julian, Spurgeon, IN (US); Sebastian Barr, Brownstone, IN (US)

(73) Assignee: Sunbeam Packaging Services, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/227,736

(22) Filed: Sep. 15, 2005

Related U.S. Application Data

(63) Continuation-in-part of application No. 10/713,418, filed on Nov. 14, 2003, now Pat. No. 6,955,380.

(51) Int. Cl.
*E05C 19/06* (2006.01)
*E05C 19/00* (2006.01)

(52) U.S. Cl. ..... 292/84; 292/87; 292/92; 292/303; 292/DIG. 15; 312/333

(58) Field of Classification Search ..... 292/80, 292/81, 87, 101, 107, 121, 128, 130, 136, 292/194, 209, 202, 228, 230, 238, 300, 303, 292/340, 341.17, DIG. 15, DIG. 37, DIG. 38, 292/DIG. 65, 84, 92; 312/333; 16/82
See application file for complete search history.

(56) References Cited

U.S. PATENT DOCUMENTS

| | | | | |
|---|---|---|---|---|
| 461,375 | A | 10/1891 | Spaunhorst | |
| 1,241,192 | A | 9/1917 | Bruder | |
| 1,618,126 | A | 2/1927 | Himmelwright | |
| 2,042,297 | A * | 5/1936 | Craighead | 292/87 |
| 3,397,001 | A * | 8/1968 | Friedman | 292/87 |
| 3,522,963 | A | 8/1970 | Farnden | |
| 3,841,518 | A | 10/1974 | Hines | |
| 3,850,463 | A | 11/1974 | Hawkins | |
| 3,971,237 | A | 7/1976 | Rasmussen | |
| 4,139,249 | A * | 2/1979 | Hillman | 312/333 |
| 4,378,948 | A | 4/1983 | Chrones | |
| 4,416,477 | A | 11/1983 | Bialobrzeski et al. | |
| 4,505,526 | A * | 3/1985 | Leck | 312/333 |
| 4,549,773 | A | 10/1985 | Papp et al. | |
| 4,560,212 | A | 12/1985 | Papp et al. | |
| 4,715,628 | A * | 12/1987 | Brink et al. | 292/19 |
| 4,717,184 | A | 1/1988 | Boyce | |
| 5,203,620 | A * | 4/1993 | McLennan | 312/334.46 |
| 5,344,226 | A | 9/1994 | Lee | |
| 5,445,451 | A | 8/1995 | Harmony | |
| 5,626,372 | A | 5/1997 | Vogt | |
| 5,645,304 | A | 7/1997 | Richardson et al. | |
| 5,730,514 | A | 3/1998 | Hashemi | |
| 5,769,517 | A * | 6/1998 | Carde | 312/333 |
| 5,795,044 | A | 8/1998 | Trewhella, Jr. et al. | |
| 6,042,157 | A | 3/2000 | Shimotsu | |
| 6,942,257 | B2 * | 9/2005 | Wong et al. | 292/128 |
| 6,955,380 | B1 * | 10/2005 | Barr | 292/84 |
| 2003/0111942 | A1 | 6/2003 | Judge et al. | |

FOREIGN PATENT DOCUMENTS

| | | | |
|---|---|---|---|
| DE | 2932123 | * | 2/1981 |

* cited by examiner

*Primary Examiner*—Carlos Lugo
(74) *Attorney, Agent, or Firm*—Camoriano and Associates; Theresa Fritz Camoriano

(57) ABSTRACT

A safety latch automatically stops a drawer or cabinet door both when opening and closing. In a preferred embodiment, the safety latch is a one-piece design and catches on the front face of the cabinet.

13 Claims, 8 Drawing Sheets

SAFETY LATCH ARRANGEMENT

This application is a continuation-in-part of U.S. patent application Ser. No. 10/713,418, filed Nov. 14, 2003 now U.S. Pat. No. 6,955,380.

BACKGROUND

The present invention relates to a safety latch arrangement. More particularly, it relates to a safety latch arrangement which can be installed very easily and operates simply. There are many known types of drawer safety latches, but they usually are difficult to install, difficult to operate, and typically only operate in one direction, to prevent a child from opening the drawer. In many cases, the latch permits the child to open the drawer enough to get his fingers into the drawer, and then permits the child to close the drawer on his fingers, which can result in injury to the child.

SUMMARY

The safety latch of the present invention may be placed so that the drawer (or door) opens just far enough for the user to be able to disengage the safety latch, but not enough to gain access to the contents of the drawer (or cabinet) until the safety latch is disengaged. Once the drawer (or door) is opened far enough to engage the safety latch, the safety latch prevents accidental closure. In order to close the drawer (or door), the user must intentionally disengage it. This prevents a child from closing the drawer (or door) on his fingers.

This safety latch catches on the front face of the cabinet and therefore does not require a separate catch mechanism to be installed. This saves time and money and makes the installation much simpler than prior art latches.

DETAILED DESCRIPTION

Figure 2:
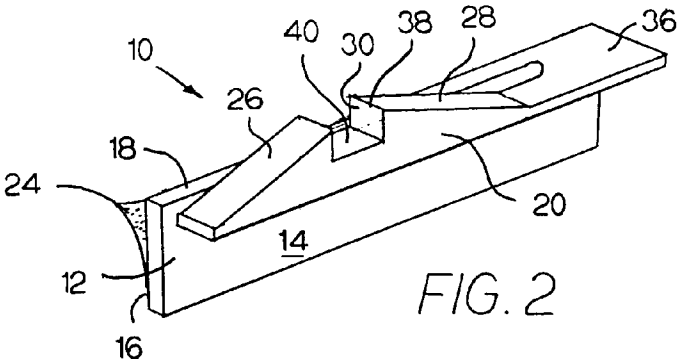
FIG. 2 is a perspective view of the drawer safety latch of FIG. 1.

FIGS. 1-8 show a first embodiment of a safety latch 10 made in accordance with the present invention. Referring to FIGS. 2, 4, 5, and 6, the safety latch 10 is a substantially "L" shaped, one-piece body (seen best in FIG. 6), including a vertical leg 12, a horizontal leg 36 projecting inwardly from the vertical leg 12, and an engaging arm 20 projecting forward from the horizontal leg 36. The vertical leg 12 serves as a mounting portion, and the engaging arm 20 serves as a latching portion.

The vertical leg 12 has an inside face 14, a flat outside face 16, and a top surface 18. In this embodiment 10, there is an adhesive strip adhered to the outside face 16, including a peel-off protective sheet 24, which covers the adhesive strip until the user is ready to install the safety latch 10 in the drawer 22, at which time he peels off the protective sheet 24 to expose the adhesive surface in order to adhere the vertical leg 12 to the side of the drawer 22.

The engaging arm 20 has a top surface including front and rear ramps 26, 28, which are colinear, and which lead up to a trough 30 located between the two ramps 26, 28. As is explained in more detail later, the trough 30 has a depth which permits it to engage the front face of the cabinet 34 (see FIG. 3). The top surface of the front ramp 26 tapers from a lower elevation in front to a higher elevation in back, where it meets the trough 30. The top surface of the rear ramp 28 tapers from a higher elevation in front, where it meets the trough 30, to a lower elevation in back.

The engaging arm 20 is cantilevered from the horizontal leg 36, and pivots upwardly and downwardly parallel to the vertical leg 12 by means of flexing of the latch material between the engaging arm 20 and the horizontal leg 36. The engaging arm 20 may be deflected by pushing it down until the apex 38 of the second ramp 28 is below the cross bar 32, allowing the drawer to open. The engaging arm 20 is naturally biased to spring back up when it is not being deflected downwardly.

Figure 1:
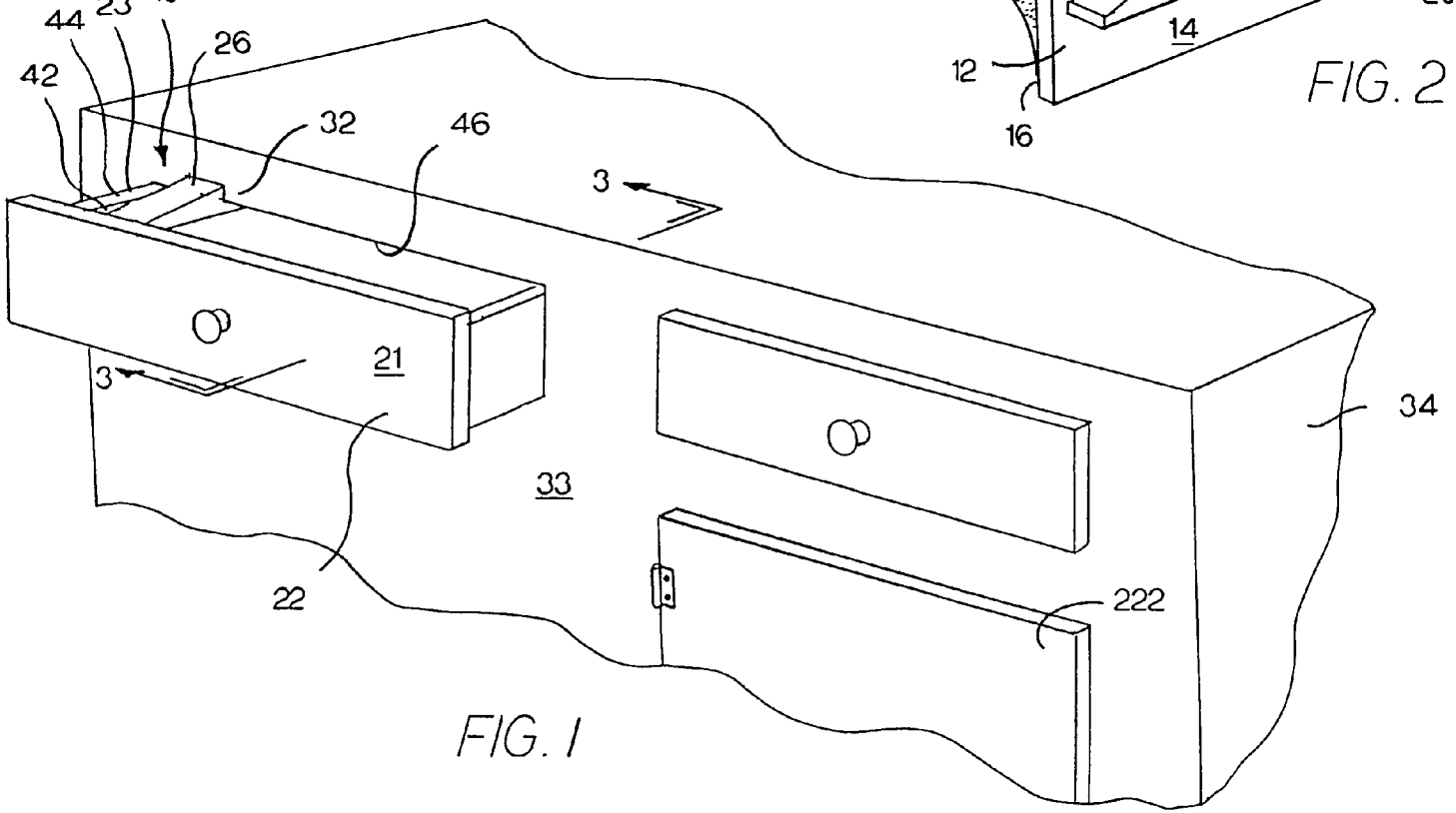
FIG. 1 is a perspective view of a cabinet with a drawer safety latch made in accordance with the present invention.
Figure 3:
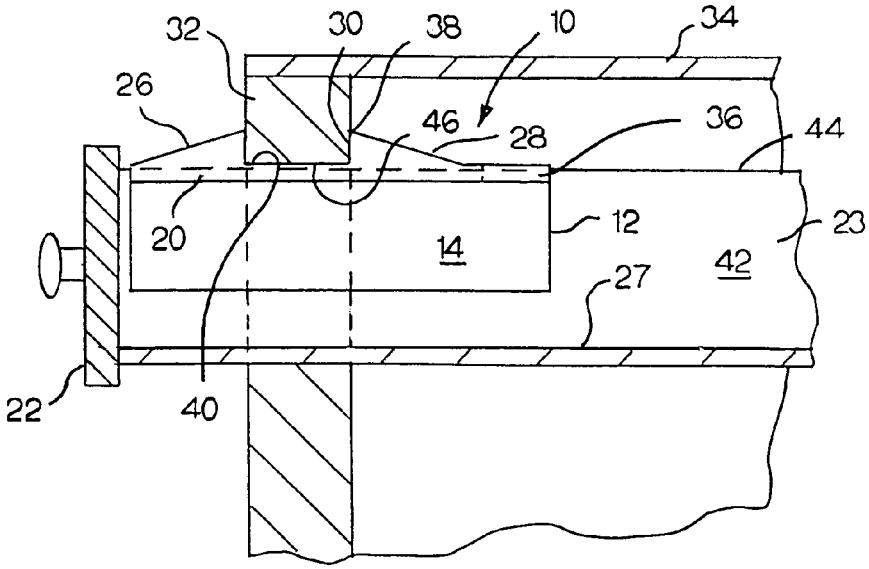
FIG. 3 is a view along line 3—3 of FIG. 1.
Figure 4:
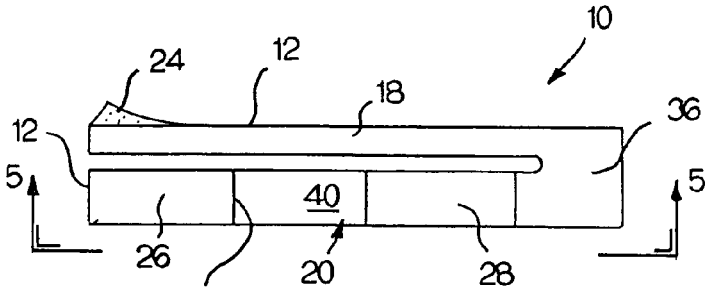
FIG. 4 is a plan view of the drawer safety latch of FIG. 2.
Figure 5:
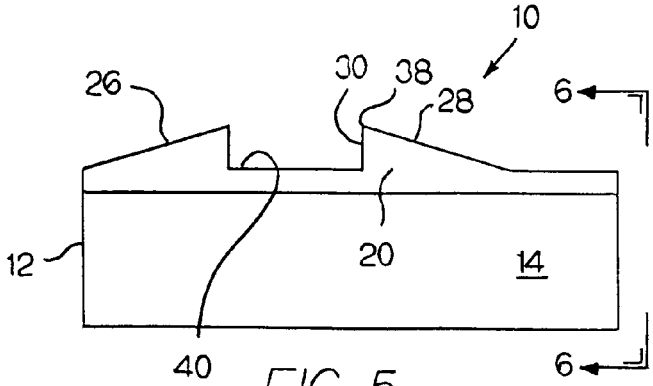
FIG. 5 is a view along 5—5 of FIG. 4.
Figure 6:
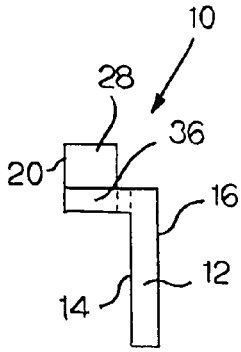
FIG. 6 is a view along 6—6 of FIG. 5.
Figure 7:
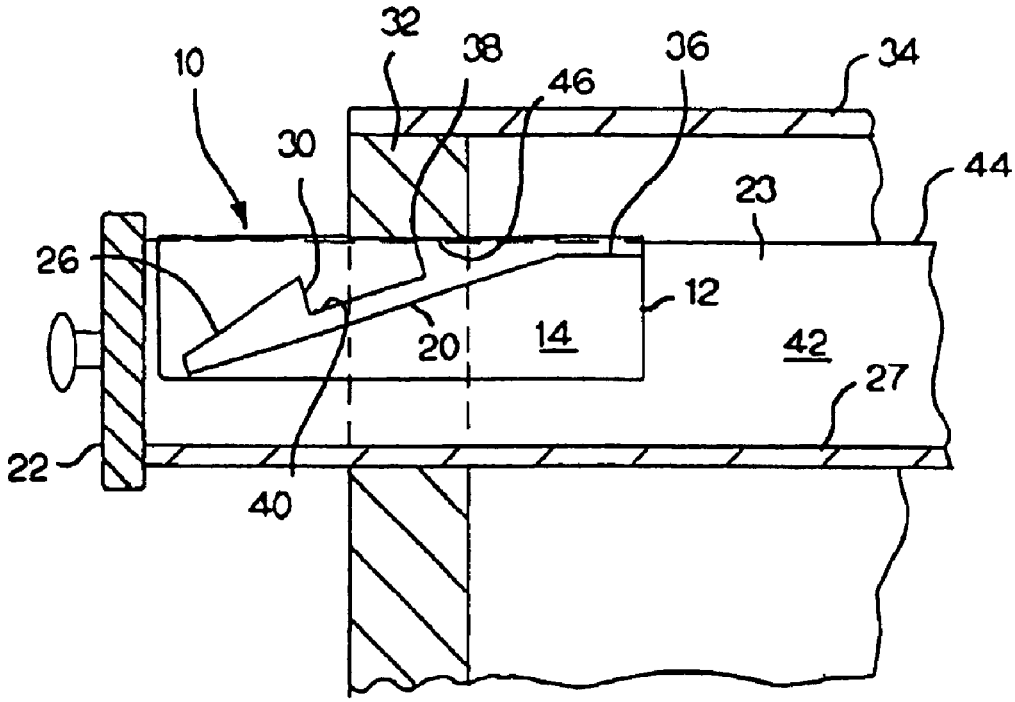
FIG. 7 is the same as FIG. 3, but with the drawer opened beyond the detent of the safety latch.

As seen in FIGS. 1 and 3, the cabinet 34 has a frame and a front face 33, which includes the cross bar 32. The front face 33 defines an opening 46 through which the drawer 22 passes as it moves forward and backward relative to the cabinet 34, and the front panel 21 of the drawer 22 covers the opening 46 when the drawer is closed, serving as a closure for the opening 46. The front face 33 and its cross bar 32 have a front-to-back depth, and the trough 30 on the latch 10 is deep enough to receive the cross bar 32 of the front face 33. The drawer 22 also has left and right sides 23, 25 and a bottom 27.

The safety latch 10 is mounted inside of the drawer 22 such that the outside face 16 of the vertical leg 12 of the safety latch 10 lies against the inside surface 42 of the left side 23 of the drawer 22. The protective sheet 24 has been peeled off of the outside face 16, allowing the vertical leg 12 to be adhered to the side 23 of the drawer 22. To facilitate the installation, the safety latch 10 is mounted such that the upper surface 18 of the vertical leg 12 is parallel to, and flush with, the upper edge 44 of the side 23 of the drawer 22, and the engaging arm portion 20 projects above the top of the side 23 of the drawer 22.

Figure 8:
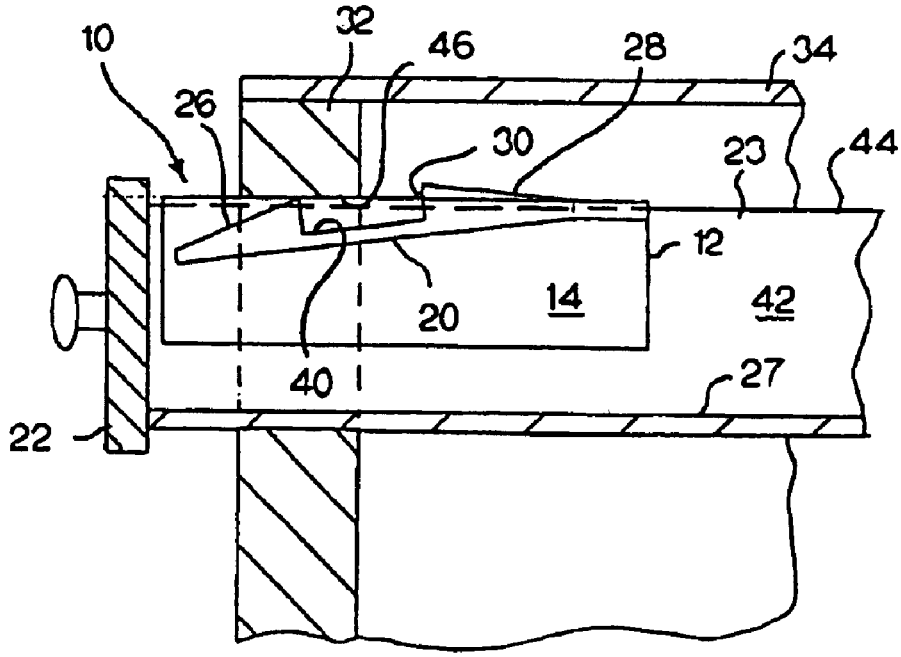
FIG. 8 is the same as FIG. 7, but with the drawer closed beyond the detent of the safety latch.

As seen in FIG. 8, as the drawer 22 is first opened, the cross bar 32 portion of the front face of the cabinet 34 bears down on the front ramp 26 of the engaging arm 20. The ramp 26 rides along the cross bar 32, flexing the engaging arm 20 further and further downwardly as the drawer 22 is pulled out, until the trough 30 reaches the cross bar 32. At that point, the engaging arm 20 snaps back and receives the cross bar 32 within the trough 30 (as seen in FIG. 3). Now, the rear vertical surface of the trough 30 abuts the rear surface of the cross bar 32, preventing any forward movement of the drawer 22, and the front vertical surface of the trough 30 abuts the front surface of the cross bar 32, preventing rearward movement of the drawer 22. Thus, in this position, the latch 10 prevents the drawer 22 from moving inwardly or outwardly.

In order to open or close the drawer 22 from the position shown in FIG. 3, the user pushes down on the front ramp 26 of the safety latch 10 until the respective ramp 26 or 28 clears the bottom 46 of the cross bar 32, and then, while the safety latch 10 is in this downwardly deflected position, the user pulls or pushes on the drawer 22 to further open or close the drawer 22.

If the drawer 22 is opened, so that the entire latch 10 is forward of the cross bar 32, then, as the drawer 22 is pushed closed, the cross bar 32 bears down on the rear ramp 28, again causing the engaging arm 20 to flex downwardly. Again, as soon as the drawer 22 is closed enough that the trough 30 reaches the cross bar 32 (as seen in FIG. 3), the engaging arm 20 snaps back up to receive the cross bar 32 within the trough 30, preventing any further movement of the drawer 22 in the forward or rearward direction. Once again, the user pushes down on the front of the engaging arm 20 to release the cross bar 32 from the trough before opening or closing the drawer any further.

In this preferred embodiment 10, the safety latch 10 is made as a single piece from a strong and flexible material, such as plastic, such that the engaging arm 20 may be readily deflected downwardly when acted upon by either the cross bar 32 or by the user, and such that it also will snap back upwardly when it is released.

The safety latch 10 may typically be installed as close as possible to the front face of the drawer 22 such that the drawer 22 opens just far enough for the user to be able to push down on the front ramp 26 of the safety latch 10 to disengage the engaging arm 20, but not far enough for a hand to reach into the drawer 22 and grab or pull out any of its contents. The distance between the front face of the drawer and the front face of the cabinet when the latch is latched, as shown in FIG. 3, should be great enough that a child's fingers will not be pinched between the drawer and the cabinet when the drawer is in the latched position.

The embodiment described above shows a simple and effective arrangement for providing a safety latch for a drawer which prevents a child from getting access to the contents of the drawer and prevents the child from pinching his fingers in the drawer.

Figure 15:
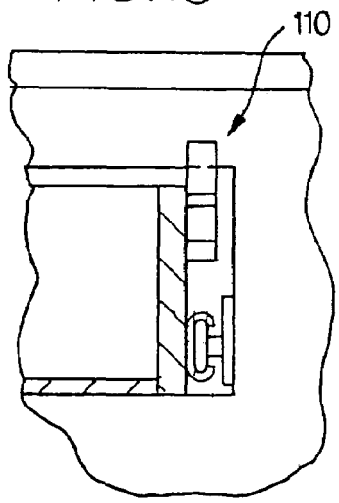
FIG. 15 is a view taken along the line 15—15 of FIG. 14.
Figure 17:
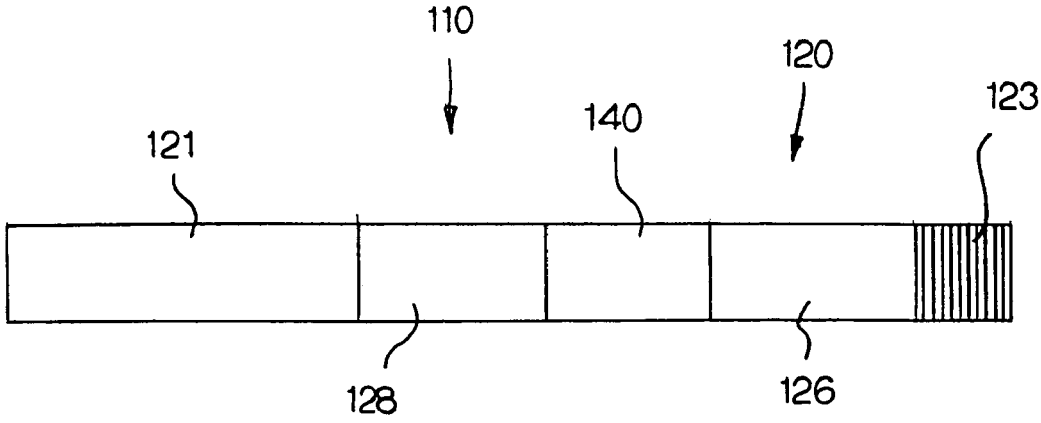
FIG. 17 is a top view of the latch of FIG. 16.
Figure 16:
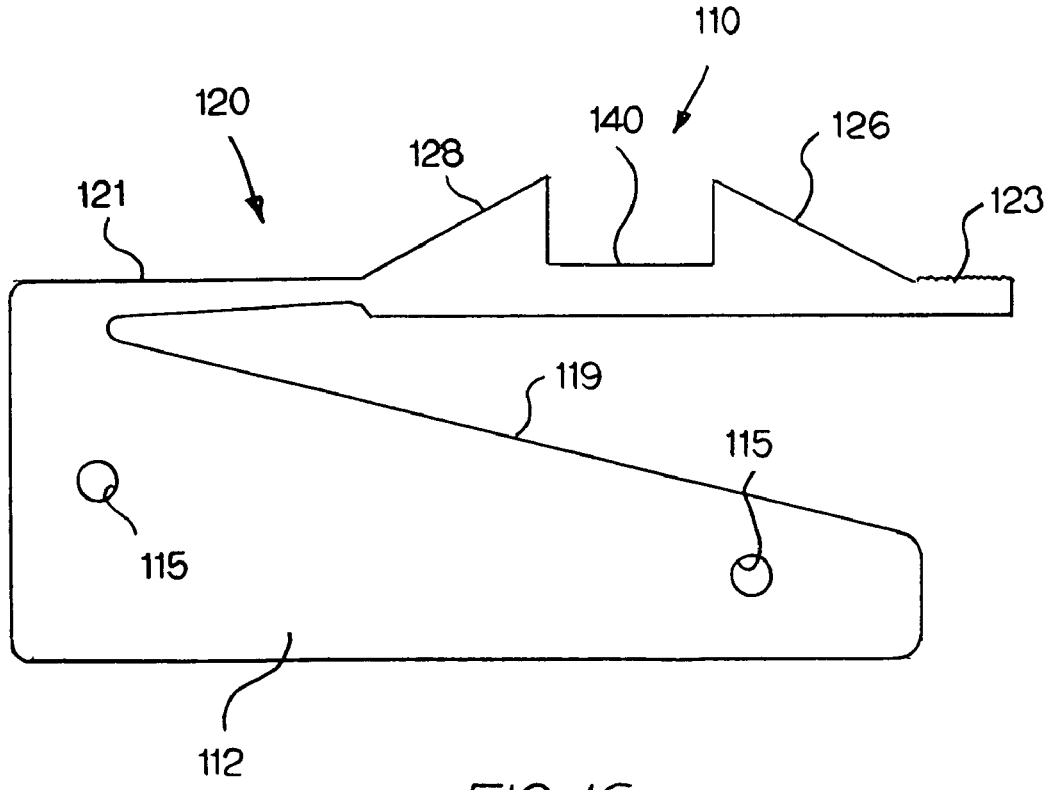
FIG. 16 is a side view of the latch of FIGS. 9-15.

One alternative arrangement is shown in FIGS. 9-17. The latch 110 is very similar to the latch 10 of the first embodiment, but it does not have the L-shaped offset (as best shown in FIGS. 16 and 17). Instead, in this embodiment, the engaging arm portion 120 lies directly above the mounting portion 112. The mounting portion 112 has two flat vertical faces and a plurality of through holes 115 which receive fasteners (not shown) to secure the mounting portion 112 to the side of the drawer. The engaging arm portion 120 projects forward from the top of the mounting portion 112, and the mounting portion 112 has a downwardly-tapered top surface 119, which provides space for the engaging arm portion 120 to flex downwardly relative to the mounting portion 112.

Similar to the previous embodiment, the engaging arm portion 120 defines a trough 140 and has forward and rear ramps 126, 128 leading up to the trough 140. The web 121 connecting the engaging arm portion 120 to the mounting portion 112 is thin enough to permit flexing of the engaging arm portion 120 relative to the mounting portion 112 but thick enough to provide a spring force that returns the engaging arm portion 120 to its original, unflexed position when it is released.

Figure 9:
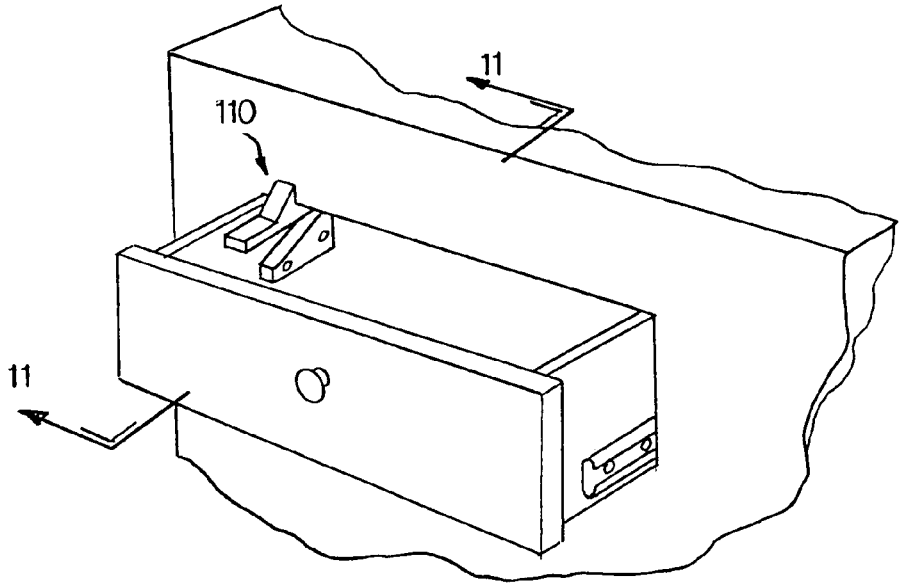
FIG. 9 is a schematic perspective view of another embodiment of a cabinet with a drawer safety latch made in accordance with the present invention and mounted on the inside of the drawer.
Figure 10:
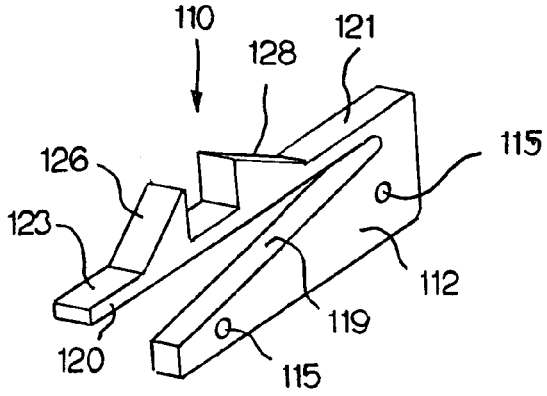
FIG. 10 is a perspective view of the latch of FIG. 9.
Figure 11:
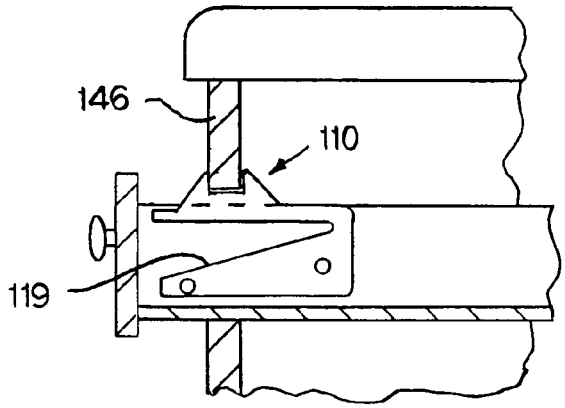
FIG. 11 is a side sectional view of the cabinet and latch of FIG. 9 with the latch in the latched position.

As in the previous embodiment, the trough 140 of the latch 110 catches directly on the front face 146 of the cabinet (shown in FIGS. 9 and 11). As a result, there is no additional catch mechanism to install onto the cabinet. Once the latch 110 is mounted on the drawer, the installation is complete. A forwardly-projecting tab 123 on the engaging arm portion 120 provides a surface against which the operator pushes to disengage the engaging arm portion 120 from the front face 146 of the cabinet.

Figure 12:
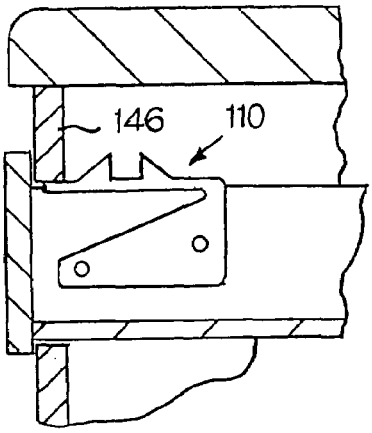
FIG. 12 is the same view as FIG. 11 but with the drawer completely closed.

FIG. 12 shows the drawer in the closed position. The latch 110 is mounted on the interior surface of the side wall of the drawer such that the forwardly-projecting tab 123 of the engaging arm portion 120 abuts the bottom surface of the front face 146 of the cabinet when the drawer is closed. As the drawer is opened, the front face 146 of the cabinet bears down on the front ramp 126 of the engaging arm 120. As the drawer is opened even further, the front ramp 126 rides along the front face 146 of the cabinet and pushes the engaging arm 120 downwardly, with the web 121 serving as a pivot point. Once the front face 146 of the cabinet is past the front ramp 126, the engaging arm portion 120 snaps back, and the front face is seated in the trough 140 (as shown in FIG. 11). To open the drawer further, the user releases the latch 110 from the front face 146 by pressing downwardly on the forwardly-projecting tab 123 and pulling the drawer outwardly.

Figure 13:
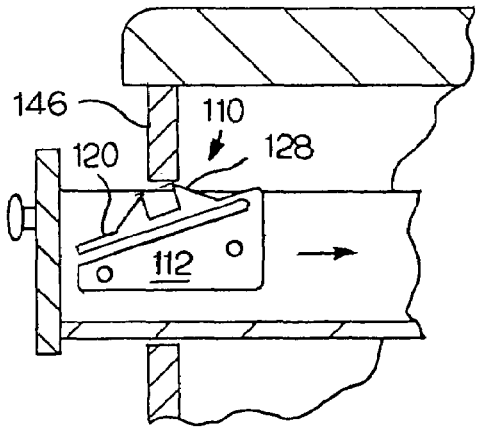
FIG. 13 is the same view as FIG. 12 but with the latch retracted.

FIG. 13 shows the drawer as it is closing. In this case, the front face 146 of the cabinet engages the rear ramp 128 as the drawer is closing, causing the engaging arm portion 120 to flex downwardly until the front face 146 reaches the trough 140, at which point the engaging arm portion 120 flexes upwardly and the trough 140 receives the front face 146 of the cabinet, latching the drawer against further movement until the latch is released. The latch is released by pressing downwardly on the forwardly-projecting tab 123 and pushing the drawer inwardly.

Figure 14:
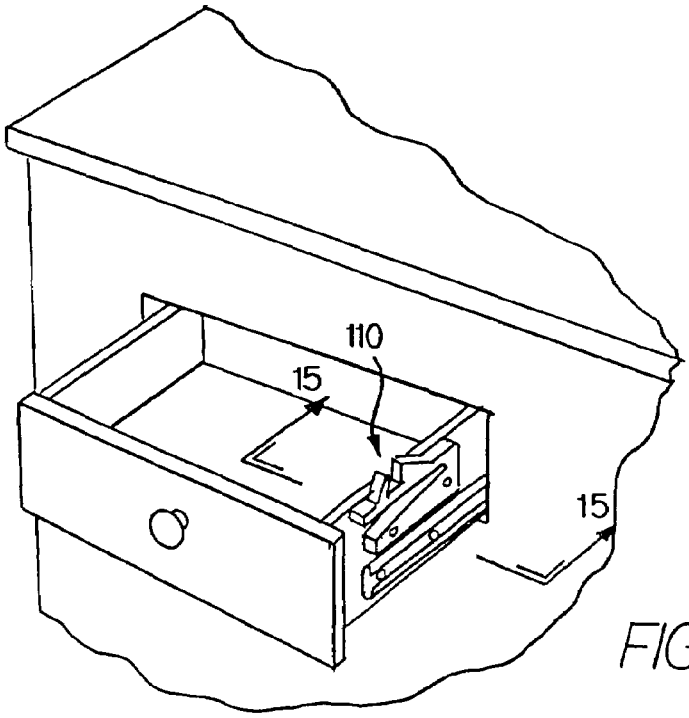
FIG. 14 is a schematic perspective view of another embodiment of a cabinet and latch made in accordance with the present invention, with the latch mounted on the outside of the drawer.

FIGS. 14 and 15 show the latch 110 mounted against the outside surface of the drawer. As best shown in FIG. 15, the latch 110 preferably is not as wide as the drawer slide mechanism, which is also mounted to the outside of the drawer, so that the drawer can slide easily without interference from the latch 110. The latch 110 in this embodiment is less than one inch wide and preferably less than 0.6 inches wide. The latch 110 mounted to the outside surface of the drawer functions the same way as the latch mounted to the inside surface of the drawer. The operator must still press downwardly on the forwardly-projecting tab 123 to open and close the drawer, and the latch still catches on the front face of the cabinet.

Figure 18:
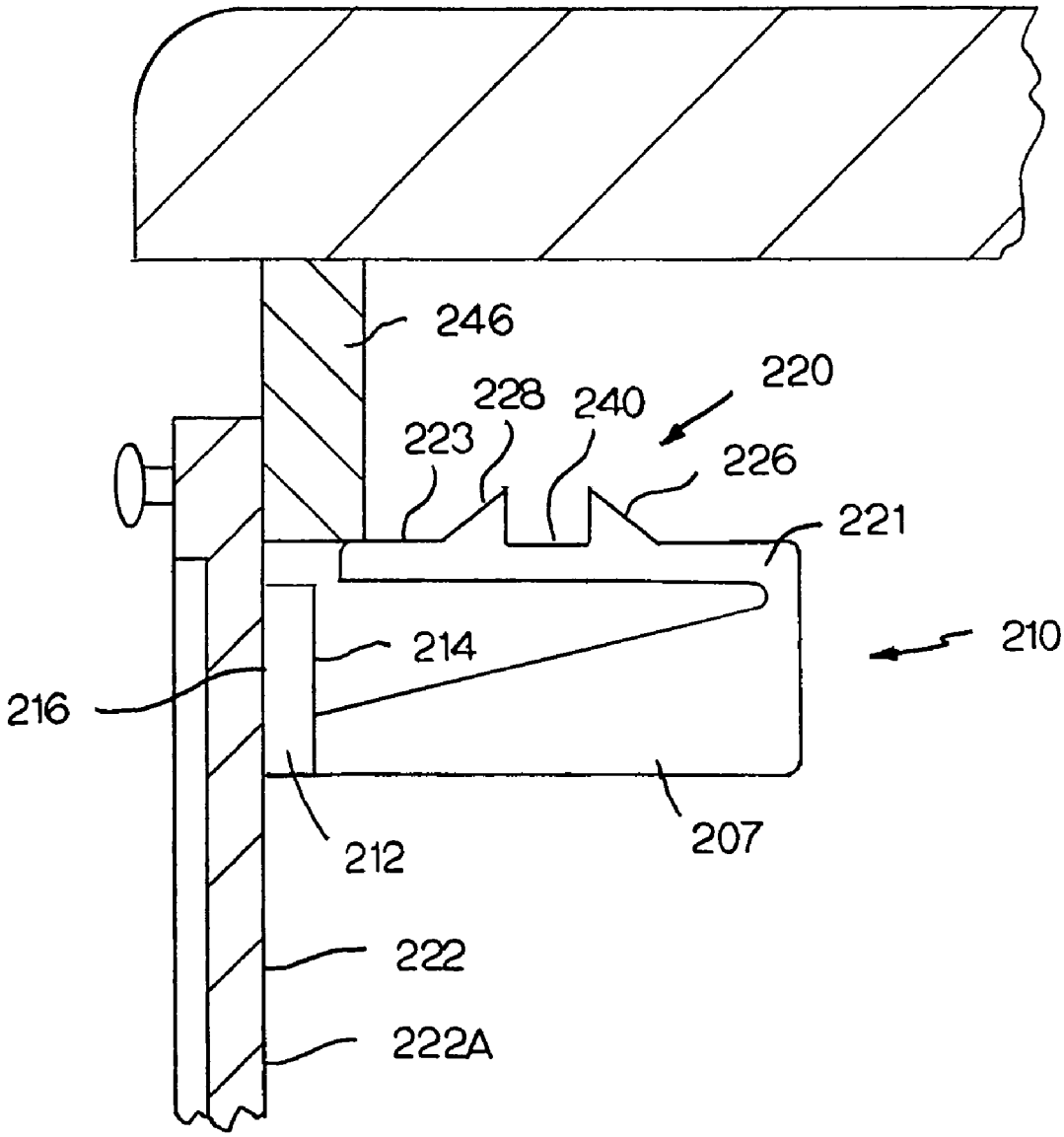
FIG. 18 is a side sectional view of yet another embodiment of a cabinet and latch made in accordance with the present invention.

FIGS. 18-21 show yet another embodiment of a safety latch arrangement made in accordance with the present invention. Unlike the previous embodiments, this latch is mounted to the front of the drawer instead of the side. As such, it also may be used on other types of closures, such as cabinet doors and the like. FIG. 18 shows the latch 210 mounted on a cabinet door 222 (which is also shown in FIG. 1). The latch 210 is mounted so that it will catch on the front face 246 of the cabinet when the door is opened, just as the previous embodiments caught on the front face of the cabinet.

Figures 19, 20, 21:
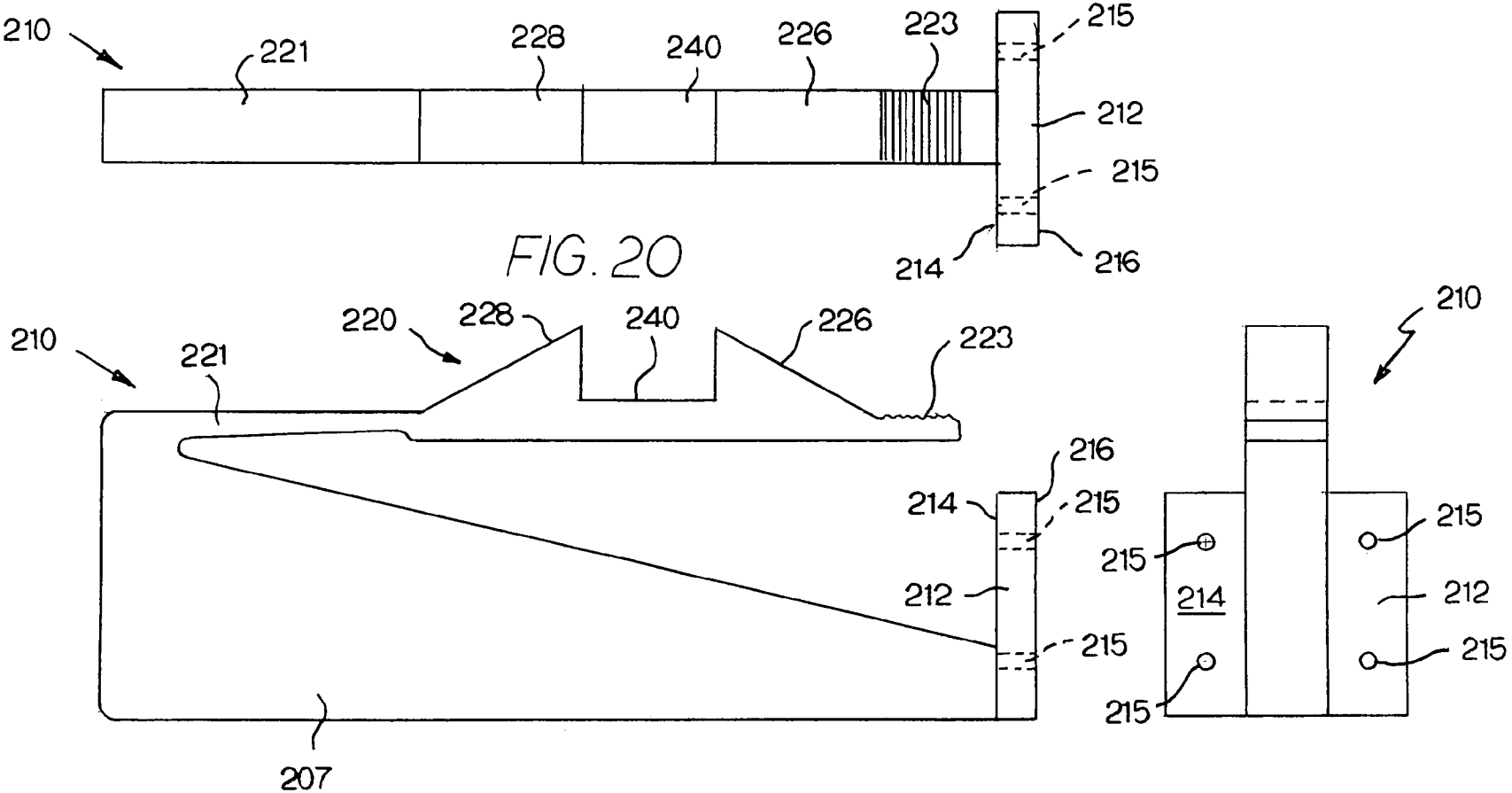
FIG. 19 is a side view of the latch of FIG. 18.
FIG. 20 is a top view of the latch of FIG. 19.
FIG. 21 is an end view of the latch of FIG. 19.

FIGS. 19-21 show the latch 210 in detail. The latch 210 is a single piece with basic components including a sloped base portion 207, a mounting portion 212, and an engaging arm portion 220. The engaging arm portion 220 lies directly above the sloped base portion 207 and projects forward (toward the mounting portion 212) from the top of the sloped base portion 207. The sloped shape of the base portion 207 provides space for the engaging arm portion 220 to flex downwardly relative to the base portion 207.

Similar to the previous embodiments, the engaging arm portion 220 defines a trough 240 and has forward and rear ramps 226, 228 leading up to the trough 240. A web 221 connects the engaging arm portion 220 to the base portion 207. The web 221 is thin enough to permit flexing of the engaging arm portion 220 relative to the base portion 207 but thick enough to provide a spring force that returns the engaging arm portion 220 to its original, unflexed position when it is released. The engaging arm portion 220 also includes a forwardly-projecting tab 223. The tab 223 provides a surface against which the operator pushes to disengage the engaging arm portion 220 from the front face 246 of the cabinet.

Unlike the previous embodiments, the mounting portion 212 is positioned forward of and perpendicular to the engaging arm portion 220 so that the latch 210 can be secured to the front of the cabinet drawer (instead of the side of the drawer) or to the cabinet door. The mounting portion 212 has an inside face 214 and an outside face 216 and, in this embodiment, it has a plurality of through holes 215 which receive fasteners (not shown) to secure the mounting portion 212 to the drawer or door. Alternatively, the mounting portion 212 may use an adhesive strip or similar means to secure the latch 210 to the drawer or door. Regardless of the mechanism, the latch 210 is mounted such that the outside face 216 abuts the inside face 222A of the door 222 as shown in FIG. 18.

This embodiment functions in the same way as the previous embodiments. As shown in FIG. 18, the latch is positioned so that the forwardly-projecting tab 223 abuts the bottom of the front face 246 of the cabinet. As the cabinet door 222 is opened, the front face 246 of the cabinet bears down on the front ramp 226 of the engaging arm 220. As the door 222 is opened even further, the front ramp 226 rides along the front face 246 of the cabinet and pushes the engaging arm 220 downwardly, with the web 221 serving as a pivot point. Once the front face 246 of the cabinet is past the front ramp 226, the engaging arm portion 220 snaps back, and the front face is seated in the trough 240. To open the door 222 further, the user releases the latch 210 from the front face 246 by pressing downwardly on the forwardly-projecting tab 223 and pulling the door 222 outwardly. Closing the door 222 involves a similar use of the forwardly-projecting tab 223.

It will be obvious to those skilled in the art that modifications may be made to the embodiments described above without departing from the scope of the present invention.

What is claimed is:

1. A cabinet latching arrangement, comprising:

a cabinet front face defining an opening;

a drawer mounted in said opening and movable in and out through said opening;

a one-piece latch including a mounting portion and an engaging arm portion, said engaging arm portion having a surface defining forward and rear ramps and a trough between said forward and rear ramps, wherein said ramps lead up to said trough:

wherein said engaging arm portion is movable relative to said mounting portion and wherein said mounting portion is fixed to said drawer such that a portion of said front face catches in said trough both when opening and when closing said drawer, and wherein flexing said engaging arm portion relative to said mounting portion releases said portion of said front face from said latch.

2. A cabinet latching arrangement as recited in claim 1, wherein said mounting portion includes a flat surface and mounting means securing said flat surface against said drawer.

3. A cabinet latching arrangement as recited in claim 2, wherein said mounting means includes a plurality of through holes defined by said mounting portion.

4. A cabinet latching arrangement as recited in claim 2, wherein said mounting means includes adhesive.

5. A cabinet latching arrangement as recited in claim 1, wherein said forward ramp tapers from a lower elevation in front to a higher elevation in back, and said rear ramp tapers from a higher elevation in front to a lower elevation in back.

6. A cabinet latching arrangement as recited in claim 1, wherein said drawer defines an interior, and said latch is mounted on the interior of said drawer.

7. A cabinet latching arrangement as recited in claim 1, wherein said drawer defines an exterior, and said latch is mounted on the exterior of said drawer.

8. A method for stopping a drawer as it moves into and out of an opening defined by the front face of a cabinet, comprising the steps of:

mounting a latch that includes forward and rear ramps and a trough between said forward and rear ramps on said drawer such that the trough of said latch catches on a portion of the front face of the cabinet both as the drawer is opening and as it is closing; and flexing said latch relative to said drawer to release the trough of said latch from said front face.

9. A cabinet latching arrangement, comprising:

a cabinet including a front face defining an opening;

a closure mounted on said cabinet and sized to cover said opening; and a latch including a mounting portion and an engaging arm portion, said engaging arm portion having a surface defining forward and rear ramps and a trough between said forward and rear ramps, wherein said ramps lead up to said trough;

wherein said engaging arm portion is movable relative to said mounting portion and wherein said mounting portion is fixed to said closure such that a portion of said front face catches in said trough both when opening and when closing said closure, and wherein flexing said engaging arm portion relative to said mounting portion releases said portion of said front face from said latch.

10. A cabinet latching arrangement as recited in claim 9, wherein said closure is a hinged cabinet door.

11. A cabinet latching arrangement as recited in claim 9, wherein said closure is a drawer.

12. A cabinet latching arrangement as recited in claim 10, wherein said mounting portion is forward of and perpendicular to said engaging arm portion and is mounted to the inside of said cabinet door.

13. A cabinet latching arrangement as recited in claim 11, wherein said mounting portion is forward of and perpendicular to said engaging arm portion, wherein said drawer includes a front panel having an interior surface, and wherein said mounting portion is mounted to said interior surface of said front panel.

* * * * *